US008703091B2

(12) United States Patent
Wang

(10) Patent No.: US 8,703,091 B2
(45) Date of Patent: Apr. 22, 2014

(54) HIGH MODULUS GRAPHITE FIBER AND MANUFACTURING METHOD THEREOF

(75) Inventor: Chih-Yung Wang, Zhongli (TW)

(73) Assignee: UHT Unitech Co., Ltd., Zhongli (TW)

( * ) Notice: Subject to any disclaimer, the term of this patent is extended or adjusted under 35 U.S.C. 154(b) by 0 days.

(21) Appl. No.: 13/562,535

(22) Filed: Jul. 31, 2012

(65) Prior Publication Data

US 2014/0037533 A1 Feb. 6, 2014

(51) Int. Cl.
*C01B 31/04* (2006.01)

(52) U.S. Cl.
USPC ..... 423/448; 423/447.1; 423/447.2; 423/447.3; 977/742

(58) Field of Classification Search
USPC ..... 423/445 R, 448, 447.1–447.3; 977/742
See application file for complete search history.

(56) References Cited

U.S. PATENT DOCUMENTS 5,209,975 A * 5/1993 Miyazaki et al. ..... 428/364
2011/0158895 A1* 6/2011 Wang et al. ..... 423/447.2

FOREIGN PATENT DOCUMENTS

TW 201122165 A * 7/2011

* cited by examiner

*Primary Examiner* — Stanley Silverman
*Assistant Examiner* — Richard M Rump
(74) *Attorney, Agent, or Firm* — Jackson IPG PLLC

(57) ABSTRACT

A high modulus graphite fiber with a tensile modulus of 270~650 GPa and a plurality of crystal structures with a thickness (Lc) of 20~70 angstroms is disclosed. Carbon fiber is used as a raw material, and a microwave focusing method is used to perform an ultra quick high temperature graphitization process to increase the temperature of the carbon fiber at a heating speed of 10~100° C. per minute to a graphitization temperature of 1400~3000° C., and then to perform a quick graphitization process for 0.5~10 minutes to form the high modulus graphite fiber.

4 Claims, 5 Drawing Sheets

HIGH MODULUS GRAPHITE FIBER AND MANUFACTURING METHOD THEREOF

FIELD OF THE INVENTION

The present invention relates to a high modulus graphite fiber and a manufacturing method thereof, in particular to the manufacturing method capable of improving the graphitization efficiency and lowering the manufacturing cost significantly.

BACKGROUND OF THE INVENTION

Carbon fiber features low specific gravity, high tensile strength, high modulus, high electric conductivity, and high thermal conductivity and has the advantage of a soft fiber that can be woven. Among the carbon fibers, a special carbon fiber with a high modulus is used extensively as an enhanced composite material for construction, aviation, and military. There are various kinds of raw materials of carbon fibers, such as rayon, polyvinyl alcohol, vinylidene chloride, polyacrylonitrile (PAN) and pitch. At present, the mainstream carbon fiber adopts polyacrylonitrile (PAN) as the raw material, and such carbon fiber has excellent mechanical strength, high quality and performance and can be manufacture stably.

The manufacturing flow of a carbon fiber using PAN as the raw material is briefly described as follows. Spinning Process (PAN raw material)→Stabilization Process (200~300° C., oxidized in air for 10~20 hours)→Carbonization Process (1000~1500° C., heated in nitrogen for more than 2 hours) →Graphitization Process (1500~3000° C., heated in argon for more than 0.5 hour)→Graphitization of Fiber. Wherein, the purpose of the graphitization process is to achieve over 90% of carbon content in the fiber and form a two-dimensional carbon ring planar mesh structure and a graphite layer structure with parallel layers. In general, an X-ray diffraction (XRD) and a Raman spectrum are used for learning the microscopic structure of the PAN carbon fibers and studying the effect of the microscopic structure of the PAN carbon fibers on the mechanical performance. In the XRD analysis, the full width at half maximum (FWHM) β of the peak value of the graphite phase is used for determining the stack height (grain thickness) of a crystal surface (002) of the graphite layer, which is generally represented by Lc as shown in the following equation (1).

$$Lc=K\lambda/\beta\cos\theta \qquad \text{Equation (1)}$$

Where, K is the form factor, λ, is the wavelength of X-ray, and θ is the scattering angle.

The greater the Lc, the more stack layers is the graphite layer, and the closer is the fiber structure. Research results show that high strength carbon fibers (such as the T-series carbon fibers manufactured by Toray Company) has a crystal area composed of approximately 5 to 6 planar layers of graphite, and high strength high modulus carbon fibers (such as the MJ series carbon fibers) have a crystal area composed of approximately 10 to 20 planar layers of graphite. Theories and actual product inspection show that the greater the grin thickness of the graphite layer, the higher is the tensile modulus of the carbon fiber (as shown in Table 1).

TABLE 1

| Model No. | Tensile Strength/ GPa | Tensile Modulus/ GPa | Lc/ angstrom | La/ angstrom |
|---|---|---|---|---|
| T300 | 3.53 | 230 | 18.3 | 40.1 |
| T700 | 4.90 | 230 | 20.8 | 41.3 |
| T800 | 5.49 | 294 | 21.4 | 43.1 |
| T1000 | 6.37 | 294 | 21.9 | 45.0 |
| M40 | 4.41 | 377 | 36.1 | 66.7 |
| M50 | 4.0 | 540 | 59.6 | 80.5 |
| M60 | 3.92 | 588 | 68.6 | 92.7 |

Japan Toray Company provided in a carbon fiber with tensile modulus of 180~220 GPa and Lc of 13~18 angstroms as disclosed in R.O.C. Pat. Application No. 94107132), indicating that Lc can be used as a standard for determining a carbon fiber structure, but the manufacturing process is the same as those disclosed process for commercial products, wherein a thermoelectric heating method is used, and the heat energy of a heat source in a furnace is radiated an/or conducted to the carbon fiber to heat the carbon fiber slowly. Carbon fiber strands are heated gradually according to different set temperatures, and pre-oxidized fibers, carbon fibers as well as graphite fibers have certain limitations.

Conventional heating and carbonization methods as disclosed in Japan Pat. No. JP200780742, R.O.C. Pat. Nos. 561207, 200902783 and 279471 focus on improving the manufacturing method that adopt a conventional thermoelectric furnace. In other words, a high temperature furnace is used for heating in the carbonization process, and different heat exchange methods are used to transmit heat energy from the outside to the inside while heating the external cavity, insulation facility, protective atmosphere and fiber. However, the drawbacks of the conventional methods include low heat conduction, difficult insulation, taking too much time to heat to the desired temperature since the temperature rising speed is affected by the heat conduction effect, and the thermal efficiency for the carbonization and graphitization process is low. Such heating method not only takes a long time, but also wastes unnecessary energy. In addition, a large quantity of insulation devices is required for a good heat insulation system to prevent heat loss of the high temperature electric furnace. The conventional methods require higher equipment requirements and costs, and thus the mass production is more difficult, and the cost of carbon fibers is higher.

Among the aforementioned prior arts, a microwave induces heating to provide a high temperature for the carbonization, and such method is generally applied in carbonization related processes as disclosed in U.S. Pat. Nos. 4,197,282, and 6,372,192 and WO Pat. No. 101084. In U.S. Pat. No. 4,197,282 issued to English Company Petroleum, a microwave carbonization process is used for processing fibers manufactured from natural organic matters such as pitch, coal, or cellulose. In the manufacturing process, a pre-carbonization process takes place at a high temperature from 300° C. to 1500° C. in an inert gas atmosphere, and then the pre-carbonized fibers are put into an inert gas and carbonized by microwave. The drawbacks of this method reside on that the pre-carbonization process conducted in the traditional high temperature furnace takes a long time (more than 4 hours) to form pre-carbonized fibers before the microwave carbonization takes place, so as to increase the level of difficulty of the manufacturing process. In addition, the precursor is a processing substance with low carbon content, so that a high strength high modulus material cannot be formed by the quick carbonization. In U.S. Pat. No. 6,372,192B1 issued to Oak Ridge Lab, a microwave plasma carbonized polyacrylonitrile (PAN) fiber is disclosed and characterized in that after the PAN fiber is pre-oxidized at 500° C., microwave is excited at low-pressure vacuum environment to produce plasma, and the plasma is used for carbonizing the pre-oxidized PAN fiber under an oxygen free environment, and the microwave energy is mainly used for producing gas plasma, and the main heating area is the surface of the fiber, and the heat capacity hardly can perform mass production of large-bundle fibers. Further, the maximum strength is only 2.3 GPa, and the modulus is only 192 GPa, and both fail to meet the high modulus specification.

SUMMARY OF THE INVENTION

In view of the aforementioned problems of the prior art, it is a primary objective of the present invention to provide a manufacturing method capable of improving the graphitization efficiency and lowering the manufacturing cost significantly.

To achieve the aforementioned objective, the high modulus graphite fiber manufactured in accordance with the present invention has a tensile modulus of 270~650 GPa, and a plurality of crystal structures with a thickness (Lc) of 20~70 angstroms, and carbon fiber is used as the raw material, and a microwave focusing method is used for an ultra quick high temperature graphitization process, and a heating speed of 10~100° C. per minute is used to increase the temperature of the carbon fiber to the graphitization temperature of 1400~3000° C., and a quick graphitization process takes place for 0.5~10 minutes to form the high modulus graphite fiber.

To achieve the foregoing objective, the high modulus graphite fiber has a tensile strength falling within a range of 3.0~6.6 GPa.

To achieve the foregoing objective, the high modulus graphite fiber is composed of 300~100000 bunchy graphite fibers.

To achieve the foregoing objective, the manufacturing method of the present invention uses carbon fiber as a raw material, and uses a microwave focusing method to heat the carbon fiber at a heating speed of heating speed 10~100° C. per minute to a temperature equal to a graphitization temperature of 1400~3000° C.; and performing a quick graphitization process for 0.5~10 minutes to form the high modulus graphite fiber.

To achieve the foregoing objective, the carbon fiber is made of a material selected from the collection of polyvinyl alcohol, vinylidene chloride, pitch and polyacrylonitrile.

To achieve the foregoing objective, the microwave focusing method of the present invention provides an elliptical cavity design capable of forming a microwave field concentration area at two focal points of the elliptical cavity separately, and providing an inert gas and a high frequency microwave, so that the electric field of the high frequency microwave and the carbon fiber passing through the microwave field concentration area produce an induced current for heating and produce a high temperature quickly under the protection of an inert gas atmosphere.

To achieve the foregoing objective, the microwave focusing method of the present invention provides a flat cavity design capable of forming a microwave field concentration area at two focal points of the elliptical cavity separately, and providing an inert gas and a high frequency microwave, so that the electric field of the high frequency microwave and the carbon fiber passing through the microwave field concentration area produce an induced current for heating and produce a high temperature quickly under the protection of an inert gas atmosphere.

To achieve the foregoing objective, the elliptical cavity is made of a material with a high sensitivity to the microwave, and the material is one selected from the collection of graphite, a carbide, a magnetic compound, a nitride, an ion compound, and any combination of the above.

To achieve the foregoing objective, the inert gas is one selected from the collection of nitrogen, argon, helium and a combination thereof.

To achieve the foregoing objective, the high frequency microwave the present invention has a frequency of 300~30,000 MHz, and a microwave power density of 1~1000 kW/m$^2$.

BRIEF DESCRIPTION OF THE DRAWINGS

FIG. 4(*b*) is a schematic view of the thermal conduction of a conventional external heating graphitization process.

DESCRIPTION OF THE PREFERRED EMBODIMENTS

The technical characteristics of the present invention will become apparent with the detailed description of the preferred embodiments accompanied with the illustration of related drawings as follows.

The present invention provides a high modulus graphite fiber such as a high modulus PAN carbon fiber, characterized in that a microwave focusing method is used to perform an ultra quick high temperature graphitization process to make the structure of the graphite layer to have a crystal thickness Lc greater than that of the traditional carbon fiber and a crystal width La smaller than that of the traditional carbon fiber, so that the carbon fiber has a high strength high tensile modulus, and the modulus falls within a range of 270~650 GPa.

Figure 1:
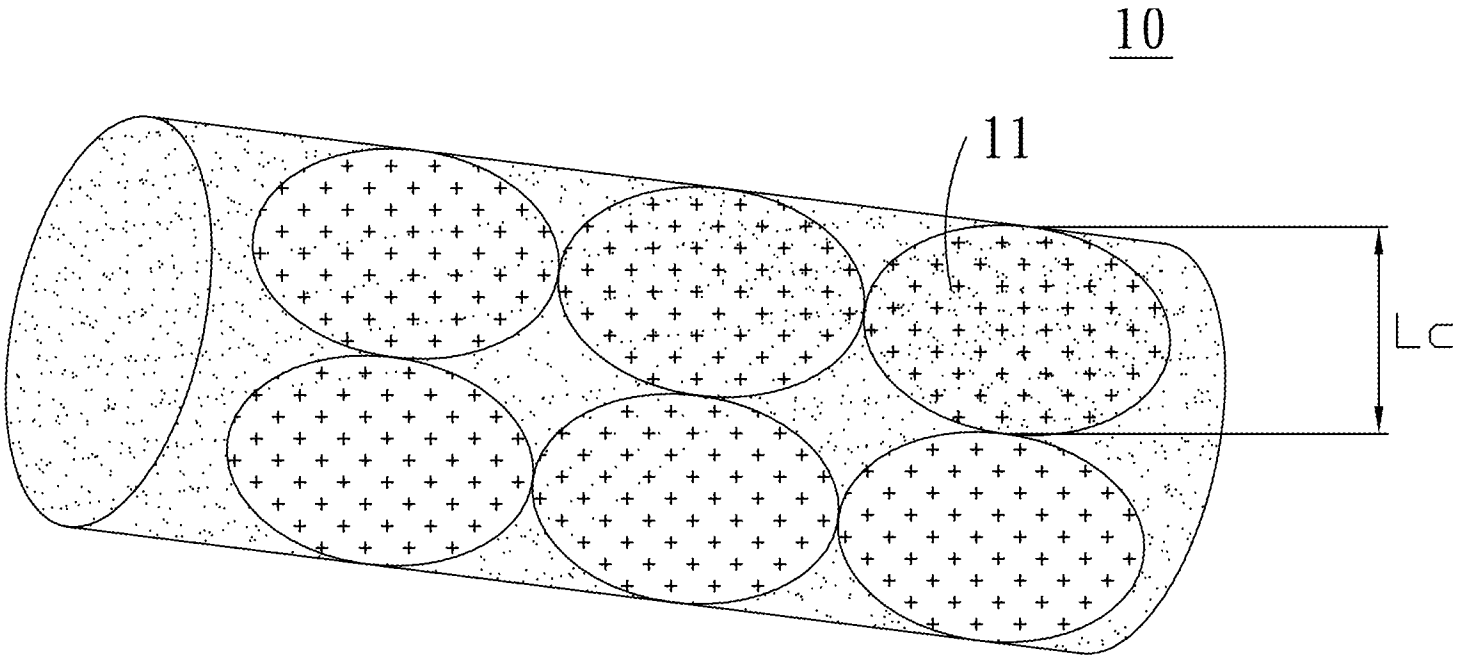
FIG. 1 is a schematic view of a high modulus graphite fiber of the present invention.

The structure of the high modulus graphite fiber 10 of the present invention is different from the structure of the carbon fiber obtained by the conventional graphitization as shown in FIG. 1. When the high modulus graphite fiber of the present invention is graphitized, the crystal width La of a plurality of crystal structures 11 in the high modulus graphite fiber remains unchanged or grows to a thickness smaller than the crystal thickness, and the crystal thickness Lc is increased (such that the relative crystal width has a higher growth, so that the crystal structure 11 has a thickness (Lc) of 20~70 angstroms, so as to increase the Lc/La ratio of the overall graphite crystal area, and the high modulus graphite fiber has a tensile strength falling within a range of 3.0~6.6 GPa, so that a specific area has a combination of Lc and La up to the level of the high strength high modulus graphite fiber.

The manufacturing method of the present invention mainly uses carbon fiber as a raw material and uses a microwave focusing method to perform an ultra quick high temperature graphitization process to increase the temperature of the carbon fiber at a heating speed of 10~100° C. per minute to the graphitization temperature of 1400~3000° C., and then perform a quick graphitization process for 0.5~10 minutes to form the high modulus graphite fiber, wherein the present invention does not use any carbon fiber strand or pre-oxidized fiber as the raw material but directly use the carbon fiber as the raw material to perform the ultra quick high temperature graphitization process by the microwave focusing method, so as to improve the graphitization efficiency, and the whole process requires no vacuum or low pressure environment, and require no induced plasma. Obviously, the manufacturing process is simpler and easier, and the manufacturing cost is reduced. Of course, the source of carbon fibers can be polyvinyl alcohol, vinylidene chloride, pitch, polyacrylonitrile, or any combination of the above.

Figure 2:
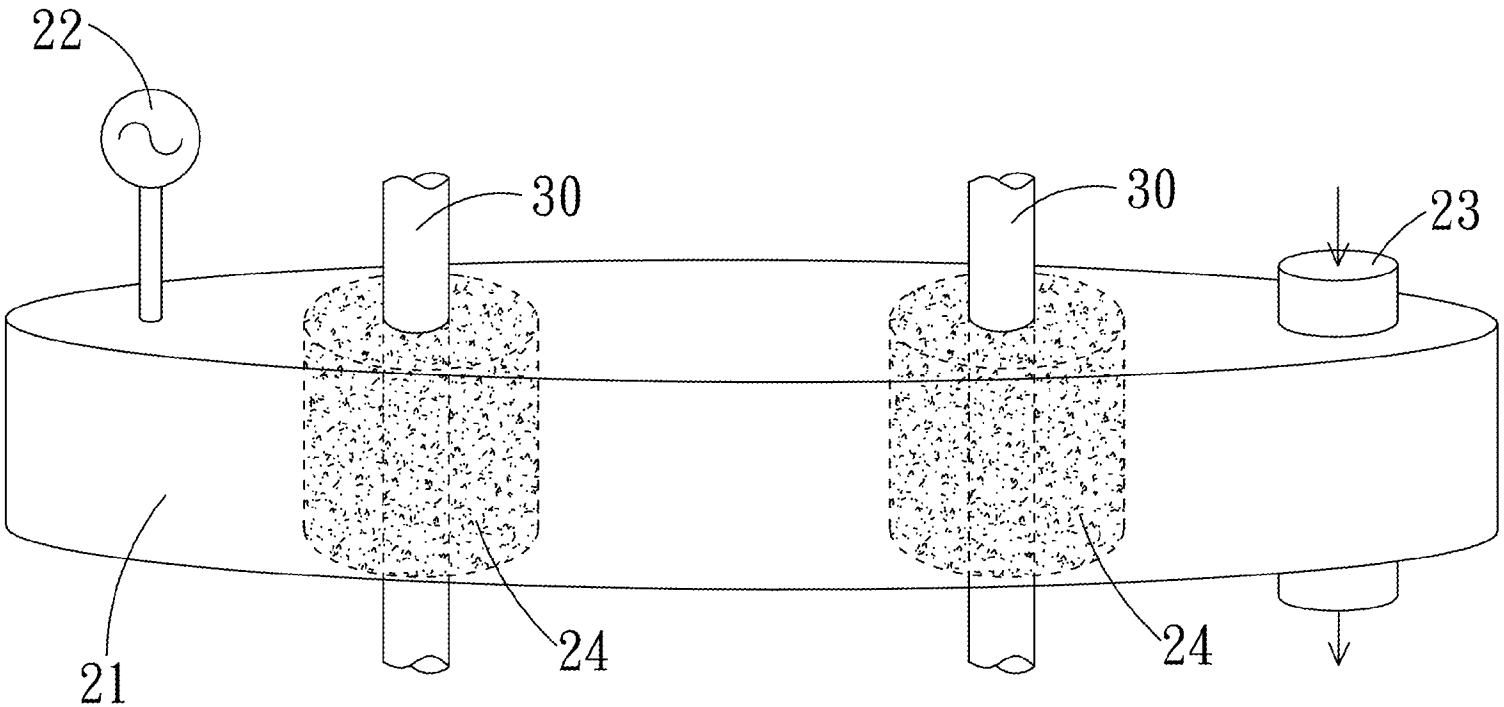
FIG. 2 is a schematic view of a structure manufactured by a microwave focusing method in accordance with a first preferred embodiment of the present invention.

With reference to FIG. 2 for a schematic view of a structure manufactured by a microwave focusing method in accordance with a first preferred embodiment of the present invention, the microwave focusing method provides a design of an elliptical cavity 21, and a microwave supply module 22 and an air supply module 23 interconnected to the elliptical cavity 21, and the air supply module 23 is provided for supplying an inert gas into the elliptical cavity 21 to prevent the carbon fiber material from being attacked and ashed by high temperature oxygen during the carbonization process. The inert gas can be nitrogen, argon, helium or any combination of the above. Under the protection of the inert gas atmosphere, the microwave supply module 22 supplies an electric field of high frequency microwaves with a microwave frequency of 300~30,000 MHz, and a microwave power density of 1~1000 $kW/m^2$, so that a microwave field concentration area 24 is formed separately at two focal points in the elliptical cavity 21, and the carbon fiber material 30 is passed through the microwave field concentration area 24 to produce an induced current to heat the carbon fiber material 30 to produce a quick high temperature to increase the temperature of the carbon fiber material 30 to the graphitization temperature of 1400~3000° C. within a short time, and a graphitization process takes place for 0.5~10 minutes. Further, the elliptical cavity is made of a material highly sensitive to microwave, and such material can be graphite, a carbide, a magnetic compound, a nitride, an ion compound, or any combination of the above for enhancing the focusing effect of the microwave field to further accelerate the graphitization process.

Figure 3:
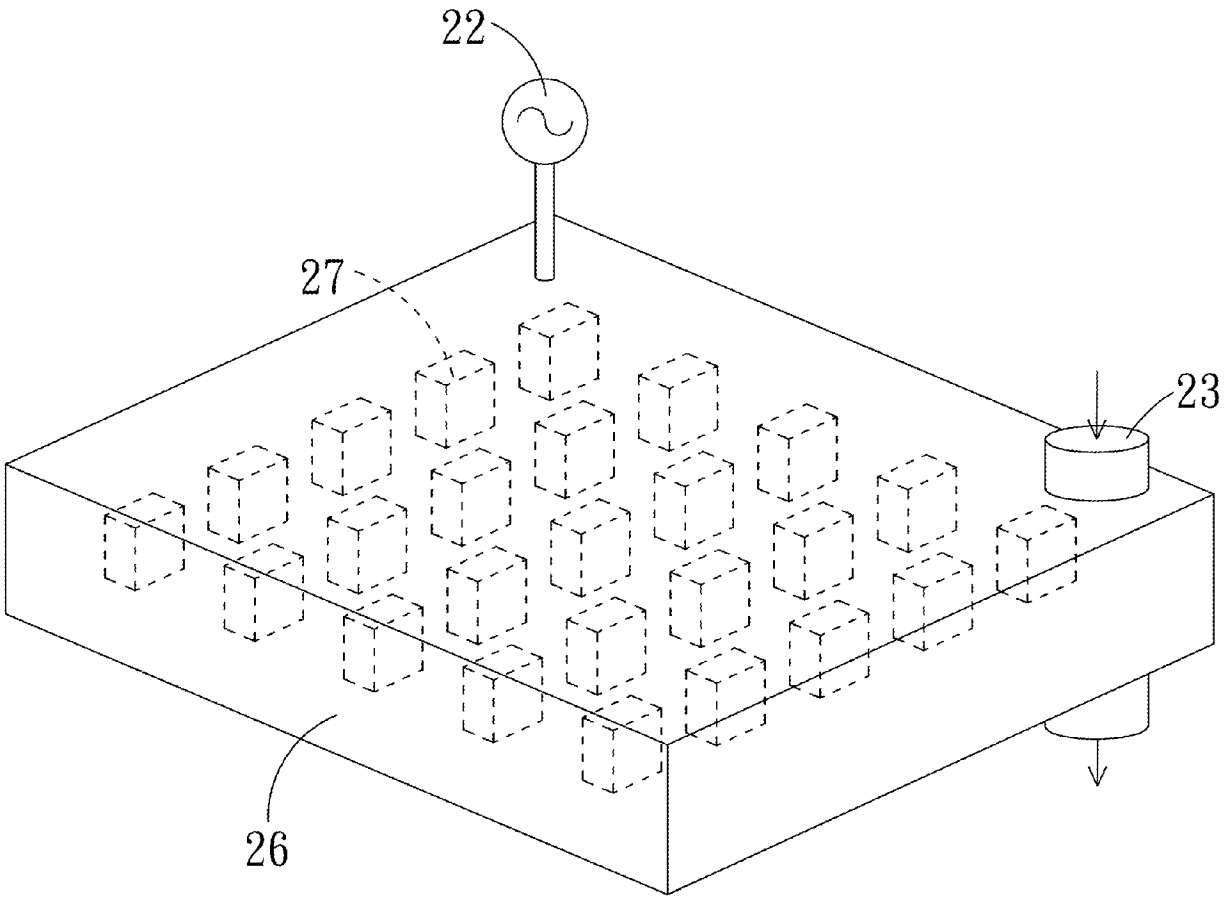
FIG. 3 is a schematic view of a structure manufactured by a microwave focusing method in accordance with a second preferred embodiment of the present invention.

With reference to FIG. 3 for a schematic view of a structure manufactured by a microwave focusing method in accordance with the second preferred embodiment of the present invention, the microwave focusing method provides a design of a flat cavity 26, and a microwave supply module 22 and an air supply module 23 interconnected to the flat cavity 26, and the flat cavity 26 has a plurality of microwave field concentration areas disposed therein. Similarly, under the protection of the inert gas atmosphere, the high frequency microwave field and the carbon fiber passing through the microwave field concentration area produce induced current to heat the carbon fiber to produce a quick high temperature to increase the temperature of the carbon fiber material 30 to the graphitization temperature of 1400~3000° C. within a short time, and a graphitization process takes place for 0.5~10 minutes. Of course, the flat cavity 26 is made of a material 27 highly sensitive to microwave as shown in the figure, and such material 27 can be arranged in matrix on a flat-plate shaped flat cavity 26 for enhancing the focusing effect of the microwave field to further accelerate the graphitization process.

The microwave focusing method is used to concentrate the microwave field at a surface of the carbon fiber and generate a uniform thermal field, so that a large amount of heat can be generated in the carbon fiber by the microwave energy within a short time according to the microwave heating principle (as shown in Equation (2)), and the heat energy is stabilized and concentrated on the carbon fiber to be graphitized.

$$P=2\pi f\in''E2 \qquad \text{Equation (2)}$$

Where, P is the microwave power absorbed per unit volume; f is the microwave frequency; ∈" is the dielectric loss; and E is the electric field strength in the material.

The carbon fiber in the microwave field has relatively high electric loss and dielectric loss, and thus induces high self-generating heat. Theoretically, the temperature increasing speed can be up to 10~150° C./second. According to the microwave heating principle, the higher the electric field strength in the material, the greater is the heating power produced by the heat generating object based on the calculation of the electric loss and the dielectric loss at the surface. Therefore, the present invention is characterized in improving the concentration of the microwave field, so that the electric field is highly concentrated at the carbon fiber. The carbon fiber is processed by the focusing and induction of the microwave to heat the carbon fiber directly to produce a high temperature and perform a quick graphitization process. Due to the resonance effect of the microwave heating, the carbonization process of the carbon fiber can be accelerated and more carbon crystals can be stacked to form larger graphite crystal molecules. In other words, a greater graphite crystal thickness can be achieved, while a better microwave sensing and heating effect can be obtained. Therefore, an autocatalytic reaction takes place repeatedly to increase the temperature of the carbon fiber quickly to the graphitization temperature (1400~3000° C.) to accelerate the rearrangement of carbon atoms to form the graphite layer.

Figure 4B:
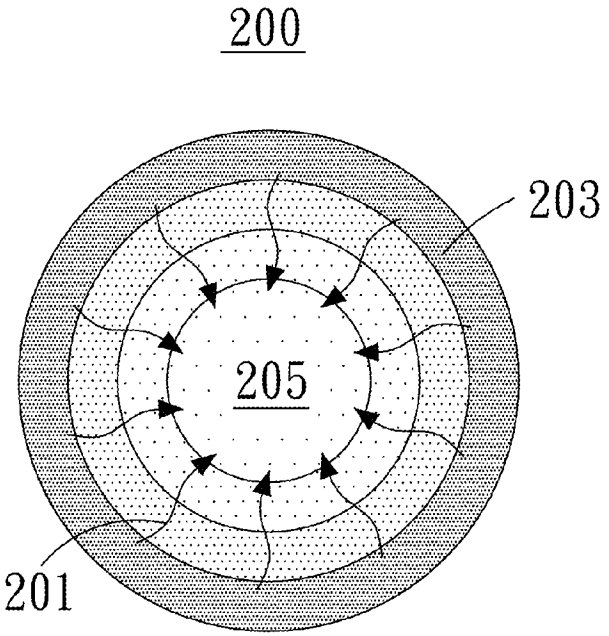
FIG. 4(*a*) is a schematic view of the thermal conduction of a microwave assisted graphitization process of the present invention.
Figure 4A:
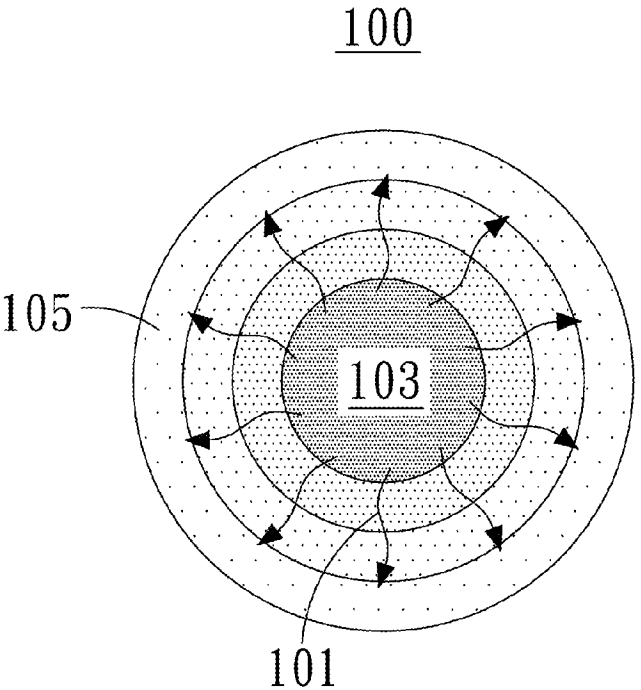

Since the heating process by microwave energy is a self heat-generating process. Unlike the conventional external heating process by thermal conduction, radiation or convection (Most present heating technologies such as the high temperature electric furnace can provide a heating speed of 10~15° C./minute, which is equivalent to the temperature increasing speed of 0.13~0.25° C./second). With reference to FIGS. 4(*a*) and 4(*b*), the high temperature area 103 of the microwave graphitization 100 of the present invention is disposed inside and the low temperature area 105 is disposed outside, so that a heat current flows in a direction from the inside to the outside. On the other hand, the high temperature area 203 of a traditional externally heated graphitization 200 is disposed outside, and the low temperature area 205 is disposed inside, so that the heat current 201 flows from the outside to the inside, and the flowing directions of the two are opposite to each other. As a result, when the carbon atoms in the carbon fiber material of the present invention are graphitized and stacked, the internal temperature of the fiber is higher than the temperature of the surface of the fiber, and the graphitization layer tends to grow in the thickwise direction to form a structure with the crystal thickness Lc. In the meantime, the microwave can reduce the energy barrier required to overcome the molecular motion, so that the time for rearranging the carbon atoms can be shortened to form the densely stacked graphite layer quickly. The thickness of the graphite crystal is even greater than the thickness obtained from the conventional manufacturing process, so that the invention can improve the graphitization efficiency and reduce the manufacturing cost.

Figure 5:
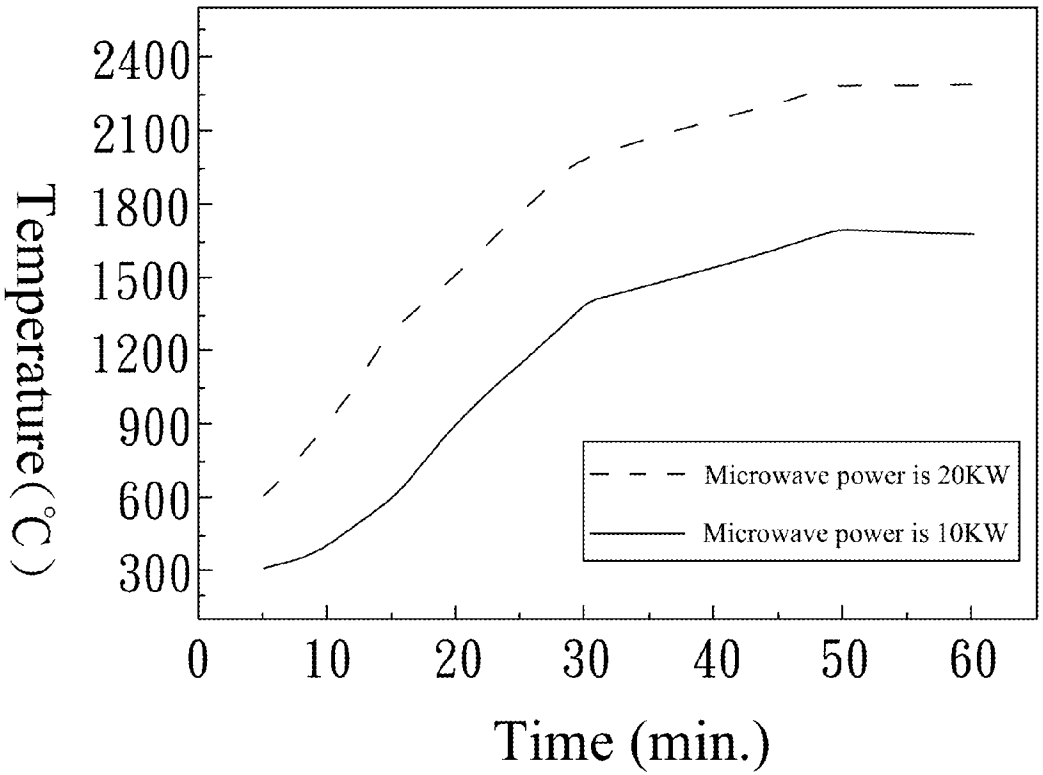
FIG. 5 is a temperature rise curve of an ultra quick high temperature graphitization process of the present invention.

With reference to FIG. 5 for a temperature rise curve of an ultra quick high temperature graphitization process of the present invention, the present invention adopts a microwave focusing method to perform an ultra quick high temperature graphitization process, wherein microwave powers of 10 KW and 20 KW are used, and a curve of the change of temperature at different times is plotted. The curve shows that the temperature increasing speed at the low temperature area is 100° C./minute, and the temperature increasing speed at the high temperature area is 20° C./minute, and these results show that the microwave focusing method of the present invention can reach the graphitization temperature within a short time and achieve the quick graphitization effect.

In addition, the following embodiment is provided for illustrating the present invention.

In this preferred embodiment, a low modulus carbon fiber T700 with the fiber number of 12K, the standard tensile strength of 4.5 GPa, and the tensile modulus of 230 GPa (produced by Japan Toray Company) and a mid modulus carbon fiber M40 with the fiber number of 12K, the standard tensile strength of 4.4 GPa and the tensile modulus of 377 GPa (produced by Japan Toray Company) are used.

In this preferred embodiment of the present invention, the carbon fibers T700 or M40 are spread open, and then passed through a low temperature furnace (at 400~600° C.) to remove a plastic layer on the surface of the carbon fibers, and then passed through a tension wheel module at a specific tension, and a microwave high temperature quick graphitization is performed at a specific speed in a protective gas (inert gas) environment, and finally the plastic layer is applied on the carbon fibers, and then the fibers are baked at a low temperature and coil to complete the whole manufacturing process.

In the first preferred embodiment, the microwave focusing and heating graphitization of the carbon fibers T700 (produced by Japan Toray Company) at the power of 10 KW for the graphitization time of 1 minute. In the second preferred embodiment, the microwave focusing and heating graphitization of the carbon fibers T700 (produced by Japan Toray Company) takes place at the power of 20 KW for the graphitization time of 1 minute. In the third preferred embodiment, the microwave focusing and heating graphitization of the carbon fibers M40 (produced by Japan Toray Company) at the power of 20 KW for the graphitization time of 1 minute. In the fourth preferred embodiment, the microwave focusing and heating graphitization of the carbon fibers T700 (produced by Japan Toray Company) takes place at the power of 30 KW for the graphitization time of 1 minute. Controls 1 to 6 are carbon fiber T700, carbon fiber T7800, carbon fiber T1000, carbon fiber M40, carbon fiber M50 and carbon fiber M60 produced by Japan Toray Company respectively.

The mechanical property test results (adopting the ASTM D4018-99 standard, sample size×30 average) are listed in Table 2.

TABLE 2

| | Tensile Strength/GPa | Tensile Modulus/GPa | Lc/angstrom |
|---|---|---|---|
| First preferred embodiment | 5.0 | 299 | 22.1 |
| Second preferred embodiment | 5.2 | 380 | 40.0 |

TABLE 2-continued

| | Tensile Strength/GPa | Tensile Modulus/GPa | Lc/angstrom |
|---|---|---|---|
| Third preferred embodiment | 4.5 | 510 | 60.4 |
| Fourth preferred embodiment | 4.2 | 603 | 69.5 |
| Control 1 | 4.90 | 230 | 20.8 |
| Control 2 | 5.49 | 294 | 21.4 |
| Control 3 | 6.37 | 294 | 21.9 |
| Control 4 | 4.41 | 377 | 36.1 |
| Control 5 | 4.0 | 540 | 59.6 |
| Control 6 | 3.92 | 588 | 68.6 |

In Table 2, the high modulus graphite fiber of the present invention has a greater graphite crystal thickness than the thickness of the conventional carbon fiber, while maintaining the original tensile strength. Compared with the prior art, the strength of the high modulus carbon fiber drops with the processing temperature, and the high modulus graphite fiber of the present invention has a tensile strength greater than that of the conventional high modulus graphite fiber.

What is claimed is:

1. A manufacturing method of a high modulus graphite fiber having a tensile modulus of 270-650GPa, and comprising a plurality of crystal structures with a thickness (Lc) of 20-70 angstroms, said method comprising the steps of:

performing an ultra quick high temperature graphitization process by using a carbon fiber as a raw material and using a microwave focusing method to heat the carbon fiber at a heating speed of 10-100° C. per minute to a temperature equal to a graphitization temperature of 1400-3000° C.; and performing a quick graphitization process for 0.5-10 minutes to form the high modulus graphite fiber, wherein the microwave focusing method provides an elliptical cavity design capable of forming a microwave field concentration area at two focal points of the elliptical cavity separately, and providing an inert gas and a high frequency microwave, so that the electric field of the high frequency microwave and the carbon fiber passing through the microwave field concentration area produce an induced current for heating and produce a high temperature quickly under the protection of an inert gas atmosphere.

2. The manufacturing method of a high modulus graphite fiber as recited in claim 1, wherein the elliptical cavity is made of a material with a high sensitivity to the microwave, and the material is selected from the group consisting of graphite, a carbide, a magnetic compound, a nitride, an ion compound, and a combination thereof.

3. The manufacturing method of a high modulus graphite fiber as recited in claim 1, wherein the inert gas is selected from the group consisting of nitrogen, argon, helium and a combination thereof.

4. The manufacturing method of a high modulus graphite fiber as recited in claim 1, wherein the high frequency microwave frequency is 300-30,000 MHz, and the microwave power density is 1-1000 kW/$m^2$.

* * * * *